US006502500B2

(12) United States Patent
Yoshino

(10) Patent No.: US 6,502,500 B2
(45) Date of Patent: Jan. 7, 2003

(54) HYDRAULIC SYSTEM FOR A WORK MACHINE

(75) Inventor: Kazunori Yoshino, Kobe-Hyogo (JP)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/845,704

(22) Filed: Apr. 30, 2001

(65) Prior Publication Data

US 2002/0157528 A1 Oct. 31, 2002

(51) Int. Cl.[7] ..... F45B 11/08
(52) U.S. Cl. ..... 91/446
(58) Field of Search ..... 91/445, 446, 448, 91/454

(56) References Cited

U.S. PATENT DOCUMENTS

| | | | | |
|---|---|---|---|---|
| 3,800,670 A | | 4/1974 | Hufeld et al. | |
| 4,206,688 A | * | 6/1980 | Haak et al. | 91/454 X |
| 4,250,794 A | | 2/1981 | Haak et al. | |
| 4,475,442 A | * | 10/1984 | Breeden | 91/446 X |
| 4,662,601 A | | 5/1987 | Andersson | |
| 4,706,932 A | | 11/1987 | Yoshida et al. | |
| 5,097,746 A | * | 3/1992 | Asaoka et al. | 91/454 X |
| 5,799,485 A | * | 9/1998 | Sandau | 91/448 X |
| 5,921,165 A | * | 7/1999 | Takahashi et al. | 91/461 X |
| 6,164,327 A | * | 12/2000 | Yoshida | 91/446 X |
| 6,186,172 B1 | * | 2/2001 | Yoshida | 91/446 X |
| 6,169,247 B1 | * | 3/2001 | Knoell et al. | 91/446 X |

OTHER PUBLICATIONS

U.S. patent application Ser. No. 09/406,893 filed Sep. 28, 1999.

* cited by examiner

*Primary Examiner*—John E. Ryznic

(57) ABSTRACT

In one aspect of the invention, the hydraulic system provided with the hydraulic pressure source and at least one meter-in spool valve. Each Spool valve has an inlet and an outlet. A hydraulic actuator is fluidly coupled with the spool valve outlet. A load hold check valve fluidly interconnects the pressure source with at least one spool valve inlet. The load hold check valve has a pressure control chamber. A three way valve has a first port in fluid communication with the pressure control chamber, a second port in fluid communication with at least one spool valve inlet, and a third port in fluid communication with the pressure source. Proved pressure and flow control to an actuator are provided, and make-up and line relief are provided without the use of an additional spool valve.

23 Claims, 4 Drawing Sheets

HYDRAULIC SYSTEM FOR A WORK MACHINE

TECHNICAL FIELD

Present invention relates to hydraulic systems and, more particularly, to hydraulic systems including individually controlled spool valves coupled with respective actuators.

BACKGROUND

In a work machine such as bulldozer, excavator or the like, multiple hydraulic stacks may be provided for operation of multiple different hydraulic loads such as hydraulic cylinders for different functions. Each hydraulic stack is typically separately controlled using a plurality of valves which direct flow depending upon pressure differentials, or positively controlled using electrical or mechanical actuators.

It is known to provide a hydraulic system with multiple hydraulic stacks, with each stack having a meter-in spool valve and a meter-out spool valve for controlling hydraulic flow to an actuator, as well as controlling hydraulic flow from the actuator to a tank and providing make-up and line relief function. Load hold check valve should be positioned within a fluid line feeding each of the hydraulic stacks in parallel. Regeneration of hydraulic oil from one hydraulic stack to another cannot be achieved since the load hold check valve remains closed except when the pressure from the pump exceeds the pressure within the parallel fluid lines leading to each hydraulic stack. Moreover, the meter-out spool-type valve may be relatively costly and bulky.

Example of a hydraulic system which may be utilized with a work machine as described above is disclosed in U.S. Pat. No. 4,250,794 (Haak et al.), which is assigned to the assignee of the present invention. Haak et al. discloses the hydraulic system including a load hold check valve with a pressure control chamber which is fluidly coupled with a two position, two-way valve for the purpose of opening and closing the load hold check valve for supplying pressurized oil to an actuator.

The present invention is directed to overcoming one or more of the problems as set forth above.

SUMMARY OF THE INVENTION

In one aspect of the invention, the hydraulic system provided with the hydraulic pressure source and at least one meter-in spool valve. Each Spool valve has an inlet and an outlet. A hydraulic actuator is fluidly coupled with the spool valve outlet. A load hold check valve fluidly interconnects the pressure source with at least one spool valve inlet. The load hold check valve has a pressure control chamber. A three way valve has a first port in fluid communication with the pressure control chamber, a second port in fluid communication with at least one spool valve inlet, and a third port in fluid communication with the pressure source.

In another aspect of the invention, a hydraulic system is provided with a hydraulic pump and at least one meter-in spool valve. Each spool valve has an inlet and an outlet. At least one hydraulic actuator is provided, with each hydraulic actuator being fluidly coupled with a corresponding spool valve outlet. A load hold check valve fluidly interconnects the pump with each spool valve inlet. A tank and at least one poppet valve assembly are also provided. Each poppet valve assembly is fluidly connected with a corresponding spool valve outlet and actuator. Each poppet valve assembly selectively interconnects corresponding actuator with the tank or an ambient pressure.

DETAILED DESCRIPTION

Figure 1:
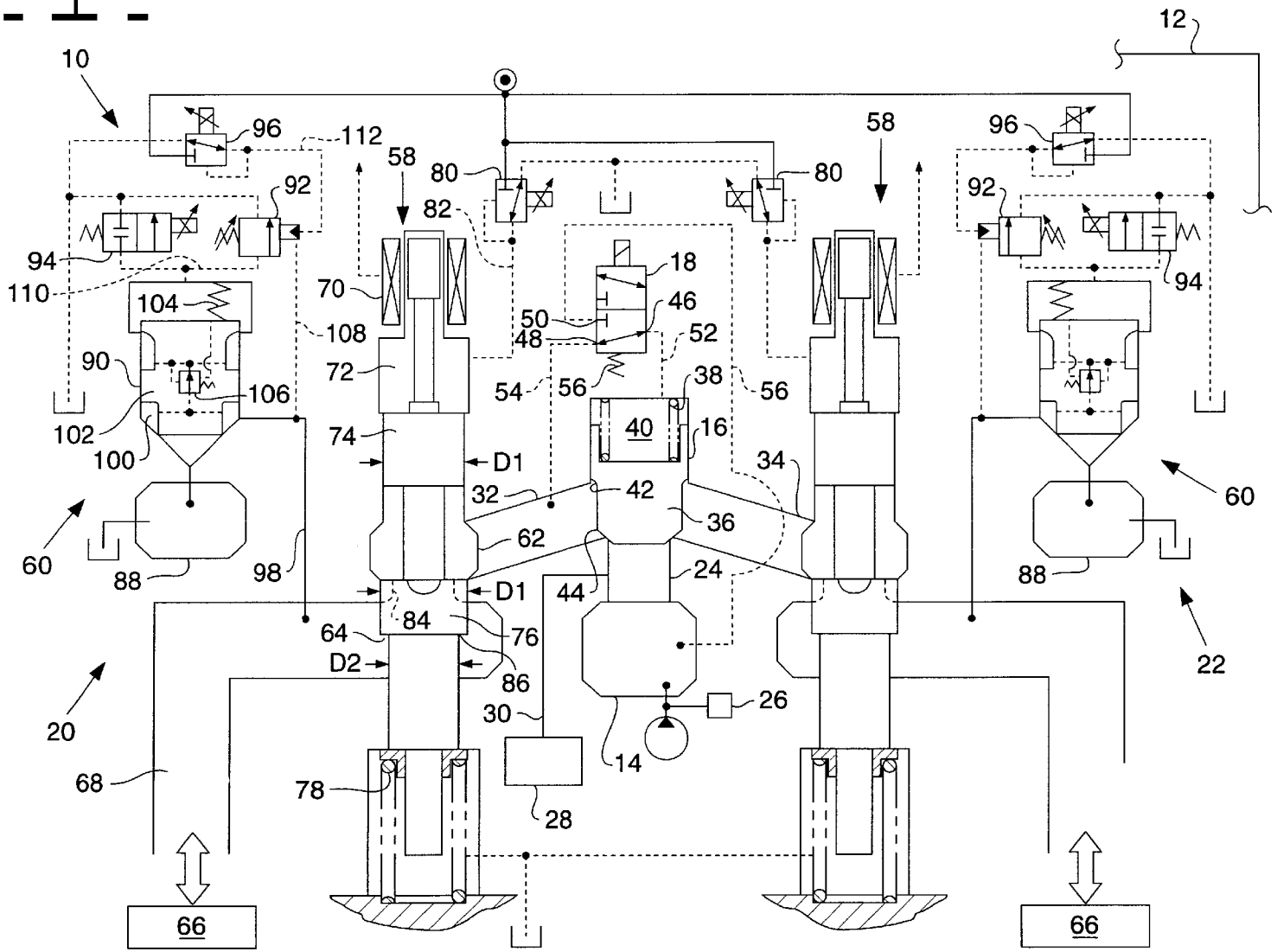
FIG. 1 is a schematic illustration of an embodiment of a hydraulic system the present invention.

Referring to the drawings, and more particularly to FIG. 1, there is shown an embodiment of a hydraulic system 10 of the present invention. Hydraulic system 10 is carried by a frame 12 (shown schematically in FIG. 1) of a work machine, such as agricultural or construction heavy equipment. Hydraulic system 10 generally includes a hydraulic pressure source 14, a load hold check valve 16, a three-way valve 18, a first hydraulic stack 20 and a second hydraulic stack 22.

Pressure source 14 provides a source of pressurized hydraulic fluid to hydraulic system 10 via an outlet line 24. In the embodiment shown, pressure source 14 is in the form of a hydraulic pump which includes a pressure sensor 26. Pressure sensor 26 provides an output signal to a controller (not shown) indicative of an output pressure of pump 14. Pump 14 is also in fluid communication with an auxiliary hydraulic load 28 via outlet line 24 and auxiliary line 30. Auxiliary hydraulic load 28 may be, e.g. a load requiring a low pressure and a high flow rate such as a hydraulic cylinder used to tip a loader bucket, etc. Of course control valves and alike may be provided in auxiliary line 30 for controlling fluid flow to an auxiliary hydraulic load 28.

Load hold check valve 16 fluidly interconnects pump 14 with each hydraulic stack 20, 22. More particularly, load hold check valve 16 fluidly interconnects outline 24 of pump 14 with parallel fluid lines 32 and 34 extending to first hydraulic stack 20 and second hydraulic stack 22, respectively. Load hold check valve 16 includes a valve body 36 which is bias to a closed position using a compression spring 38. A pressure control chamber 40 is present within load hold check valve 16 on the back side of valve body 36 in the area of spring 38. Valve body 36 includes first and second annular shoulders 42 and 44 which provide areas against which a pressurized fluid within parallel fluid lines 32 and 34 may act as will be described in more detail hereinafter.

Three-way valve 18 includes a first port 46, a second port 48 and third port 50 which may each function as an inlet or an outlet depending upon the direction of fluid flow. First port 46 is in fluid communication with pressure control chamber 40 via fluid line 52. Second port 48 is in fluid communication with an inlet to first hydraulic stack 20 and second hydraulic stack 22 via fluid 54, as will be described in more detail hereinafter. Third Port 50 is in fluid communication with pump 14 via fluid line 56.

Three-way valve 18 is a two-position valve which may be selectively actuated to couple first port 46 with either of second port 48 or third port 50. Three-way valve 18 is bias to a position coupling first port 46 with second port 48, as schematically represented by spring 56. Three-way valve 18 may be selectively actuated to couple first port 46 with third port 50 such that the output pressure of pump 14 also exists within pressure control chamber 40 on the back side of valve body 36.

First hydraulic stack 20 and second hydraulic stack 22 are configured substantially identical to each other. For simplicity sake, a detailed description of only first hydraulic stack 20 will be provided hereinafter, being understood that second hydraulic stack 22 is configured and operates substantially identically.

First hydraulic stack 20 generally includes a meter-in spool valve 58 and a poppet valve assembly 60. Meter-in spool valve includes a inlet 62, and an outlet 64. Inlet 62 is in fluid communication with parallel fluid 32 extending from load hold check valve 16. Outlet 64 is in fluid communication with an actuator 66 via a supply line 68. Actuator 66 may be in the form of, e.g., a hydraulic cylinder or the like which is operatable under a relatively wide range of operating conditions. For example, actuator 66 may be in the form of a hydraulic cylinder requiring high pressure, low flow operating conditions or low pressure, high flow conditions.

Meter-in spool valve 58 includes a stroke sensor 70, pressure control chamber 72, body 74, spool land 76 and spring 78. Stroke sensor 70, in the embodiment shown, is in the form of an inductive sensor which provides an output signal to a controller (not shown) indicative of a position of spool land 76 during operation. Pressure control chamber 72 is in fluid communication with a stroke control proportional valve 80 via fluid line 82 and receives a pressurized fluid therein for selectively positioning spool land 76 during operation. The pressure of the fluid within pressure control chamber 72 and thus inturn the position of spool land 76, is controlled using stroke control proportional valve 80. Body 74 fluidly separates pressure control chamber 72 from inlet 62.

Spring 78 biases spool land 76 and body 74 to a closed position of spool land 76. A spring force applied by spring 78 can of course be tailored to the particular application.

Spool land 76 is selectively moveable between a closed position (shown in FIG. 1) and an open position lured by inlet 62 and outlet 64 are fluidly interconnected together. Spool land 76 includes a plurality of axially extending notches 84 which are radialy spaced around the periphery of spool land 76. Notches 84 extend a predetermined distance in an axial direction from the end face of spool land 76 which faces toward body 74. The extent to which spool land 76 is moved in a direction towards compression spring 78 controls the port opening area between inlet 62 and outlet 64, thereby also controlling the amount of flow past spool land 76. The terms and "inlet" and "outlet" are used herein for convenience sake. It is to be understood that in certain operating conditions, as will be described hereinafter, inlet 62 and outlet 64 may have opposite functionality. Since the principal direction is from inlet 62 to outlet 64, these terms have been selected for convenience sake.

Spool land 76 also includes a pressure area in the form of a shoulder 86 which is in fluid communication with actuator 66. Shoulder 86 defines an area against which pressurized fluid within supply line 68 may serve an axial force for biasing, in addition to compression spring 78, spool land 76 to a closed position. The pressure area defined by shoulder 86 is of course smaller then the pressure area of the axial face of body 74 facing toward pressure chamber 72 as may be clearly seen in FIG. 1.

Poppet valve 60 is fluidly connected with spool valve outlet 64 and actuator 66. Poppet valve 60 is selectively actuated to provide the dual functionality of both a make-up function as well as a line relief function. To that end, poppet valve assembly 60 selectively fluidly interconnects actuator 66 with either of tank 88 or an ambient pressure for a make-up function or for a line relief function, depending upon operation positions.

Poppet valve assembly 60 includes a pilot flow amplification type poppet valve 90, a pilot relief valve 92, a meter-out flow control pilot control valve 94 and a proportional pressure reduction valve 96. Pilot flow amplification type poppet valve 90 primarily provides the make-up function, and valves 92, 94 and 96 primarily provide the line relief and pressure setting control function.

Pilot flow amplification type poppet valve 90 is in fluid communication with tank 88, which in the embodiment shown is at ambient pressure. Pilot flow amplification type poppet valve 90 is also in fluid communication with actuator 66 via fluid line 98. The pressure within supply line 68 leading to actuator 66 flows into an annular chamber 100 within pilot amplification type poppet valve 90 to exert an axial force against valve body 102 in opposition a force exerted by spring 104. An opposing fluid force is also exerted against the opposite side of valve body 102 and a normally open poppet 106 corresponding to the pressure within supply line 68. More particularly, the pressure in fluid line 98 passes through fluid line 108, pilot relief valve 92 and fluid line 110 to exert an opposing force on the back side of valve body 102 and poppet 106.

Pilot relief valve 92 is in fluid communication with supply line 68 via fluid lines 108 and 98. Pilot relief valve is bias to a closed position, and pops off at a selected line pressure. Pilot relief pop off pressure of pilot relief valve 92 is selectively adjusted via fluid line 112 using proportional pressure reduction valve 96. Meter our flow control pilot spool valve 94 is connected in parallel with pilot relief valve 92, and functions to proportionally control the movement of the poppet valve 90.

Stroke control proportion valve 80 controls the fluid pressure which is exerted within pressure control chamber 72, depending upon the output signal from stroke sensor 70 and a desired input command signal provided to a controller (not shown). During use pressure source 14 provides hydraulic fluid as an output pressure to outlet line 24 leading to load hold check valve 16. When Three-way valve 18 is in the position shown in FIG. 1, the fluid pressure within parallel fluid lines 32, 34 also exist within pressure control chamber 40 of load hold check valve 16 on the back side of valve body 36. If the pressure outputted from pump 14 is greater then the combined axial force exerted against valve body 36 by compression spring 38 and the fluid pressure within pressure control chamber 40, valve body 36 lifts and allows pressurized hydraulic fluid to flow to meter-in of spool valve 58. Pressurized fluid is applied to pressure control chamber 72 within meter-in spool valve 58 in opposition to compression spring 78 to move spool land 76 to a selected position following a predetermined amount of fluid flow between inlet 62 and outlet 64. The pressurized hydraulic fluid then flows through supply line 68 to actuator 66.

Load hold check valve 36 may be closed by moving three-way valve 18 to a position such that first port 46 is fluidly coupled with third port 50, thereby coupling the output pressure of pump 14 to pressure control chamber on the back side of valve body 36. Additional force provided by compression spring 38 moves valve body 6 to the closed position shown in FIG. 1.

In the event that the output pressure from pump 14 falls below the fluid pressure within supply line 68, such as when pump 14 provides fluid under low pressure conditions to an auxiliary hydraulic load 28, it is also possible to allow back flow of the hydraulic fluid more effective operation of auxiliary hydraulic load 28. For example, assuming valve body 36 is in a closed position and spool land 76 is in an open position, the pressure within supply line 68 also exists within parallel fluid line 32 and exerts an axial force against valve body 36 at shoulders 42 and 44. If three-way valve is bias to the position coupling the output pressure of pump 14 to match your control chamber 40, a lower pressure thus exist under a high flow rate, low pressure operating condition during operation of auxiliary hydraulic load 28. The higher pressure hydraulic fluid exerts an axial force against valve body 36 at shoulders 42, 44 moving valve body 36 to an open position allowing the higher pressure hydraulic fluid to be fluidly coupled with the output line 24 from pump 14 which couples in parallel with auxiliary line 30 leading to auxiliary hydraulic load 28.

The exact position of spool land 76 is sensed using stroke sensor 70. The sensed position of spool land 76 is utilized to apply an appropriate pressure to pressure control chamber 72 on the back side of body 74 allowing accurate positioning of spool land 76 within meter-in spool valve 58. The pressure area defined by shoulder 86 of spool land 76 also allows the pressure within supply line 68 to exert an axial force which, in combination with the spring force applied by spring 78, opposes the axial force applied to valve body 74 within pressure control chamber 72 by the pressurized fluid therein. These opposing forces allow improved control and positioning of spool land 76.

In the event that the fluid supply from pump 14 is insufficient to provide adequate fluid flow to actuator 66, the cavitation may occur which is undesirable. Pilot flow amplification type poppet valve opens when the pressure exceeds the pressure within supply line 68, thereby providing a make-up function of hydraulic fluid from tank 88 to supply line 68, and ultimately to actuator 66 to inhibit the cavitation condition.

Moreover, should the pressure within supply line 68 exceed a predetermined value, the same pressure is exerted against pilot relief valve 92. The pop off pressure of pilot relief valve 92 is controlled using proportional pressure reduction valve 96, and the flow rate from pilot relief valve 92 is controlled using meter-out control flow control pilot spool valve 94. Thus, the pop off pressure within supply line 68 as well as the rate of pressure bleed from supply line 68 are controlled using valves 92, 94 and 96, concurrently.

Figure 2:
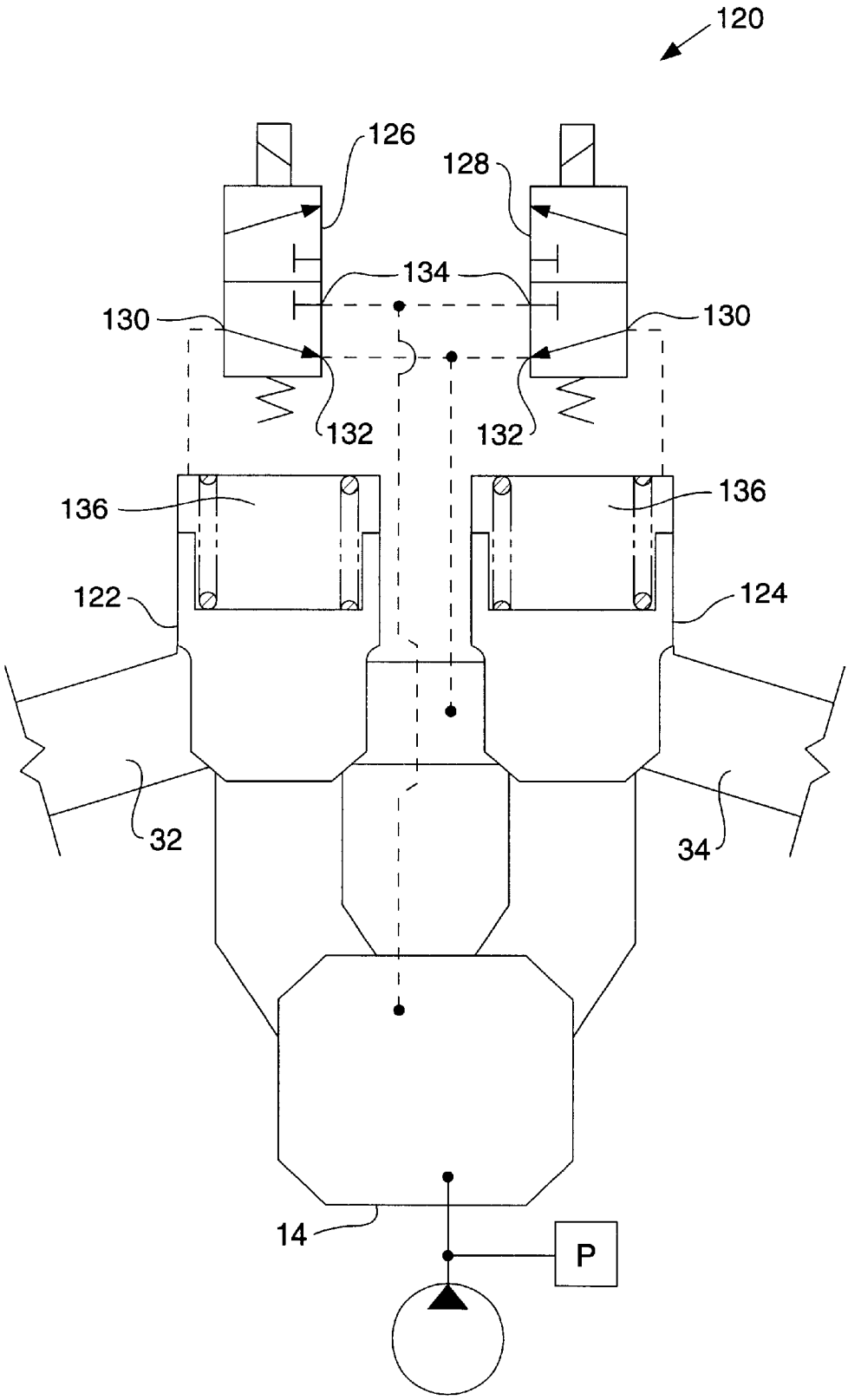
FIG. 2 is a schematic illustration of a portion of another embodiment of a hydraulic system of the present invention.

Referring now to FIG. 2, another embodiment of the hydraulic system 120 of the present invention is shown. Hydraulic system 120 includes the first hydraulic stack 20 and the second hydraulic stack 22 which are respectively coupled with parallel fluid lines 32 and 34, the same as shown in FIG. 1. For simplicity sake, first hydraulic stack 20 and second hydraulic stack 22 are not shown in FIG. 2. Hydraulic system 120 also includes pressure source in the form of a pump 14, similar to hydraulic system 10 shown in FIG. 1. However, pump 14 is fluidly coupled in parallel with two separate load hold check valves 122 and 124, as well as two separate three-way valves 126, 128. Each three-way valve 126, 128 includes a first port 130, a second port 132 and third port 134. Each first port 130 is fluidly coupled with a pressure control chamber 136 of an associated load hold check valve 122, 124, respectively. Each second port 132 is fluidly coupled with each spool valve inlet via parallel fluid lines 32, 34. Each third port 134 is fluidly coupled with the output pressure from pump 14.

Figure 3:
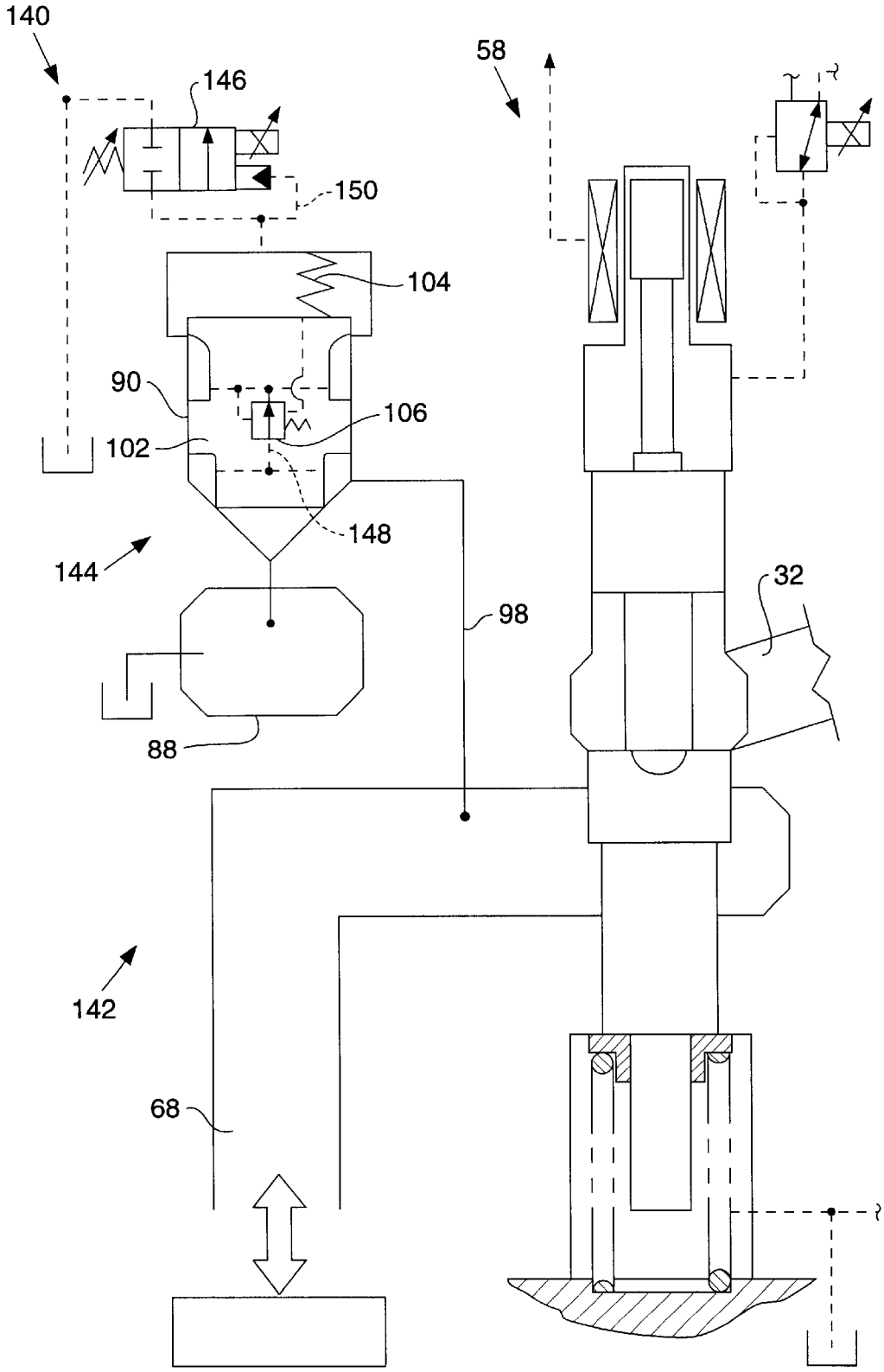
FIG. 3 is yet another schematic illustration of another embodiment of a hydraulic system of the present invention.

FIG. 3 illustrates yet another embodiment of a hydraulic system 140 of the present invention. Hydraulic system 140 includes a pump 14, load hold check valve 16 and three-way valve 18 which are coupled in parallel with a first hydraulic stack 142 and a second hydraulic stack (not shown), similar to the embodiment of hydraulic system 10 shown in FIG. 1. Since the configuration of pump 14, load hold check valve 16 and three-way valve 18 is the same is in FIG. 1, and first hydraulic stack is the same as the illustrated second hydraulic stack, only the first hydraulic stack 142 is shown in FIG. 3 for purposes of simplicity.

First hydraulic stack 142 includes meter-in spool valve 58 which fluidly interconnects parallel fluid line 32 with supply line 68, the same as in FIG, 1. Hydraulic system 140 includes a poppet valve assembly 144 which is also fluidly coupled in parallel with meter-in spool valve 58. However, poppet valve assembly 144 differs from poppet valve assembly 60 shown if FIG. 1. Poppet valve assembly 144 includes a pilot flow amplification type poppet valve 90 which is fluidly coupled in series with a variable pressure pilot relief and meter-out flow control pilot spool valve 146. The pressure within fluid line 98 flows through notched drill passage 148 to exert pressure against poppet 106 on the opposite side of valve body 102 within currently with spring 104. The same fluid pressure acts against variable pressure pilot relief/meter-out flow control valve 146 via fluid line 150, which inturn controls both the pilot relief pop off setting as well as the flow bleed off rate during pressure relief condition.

Figure 4:
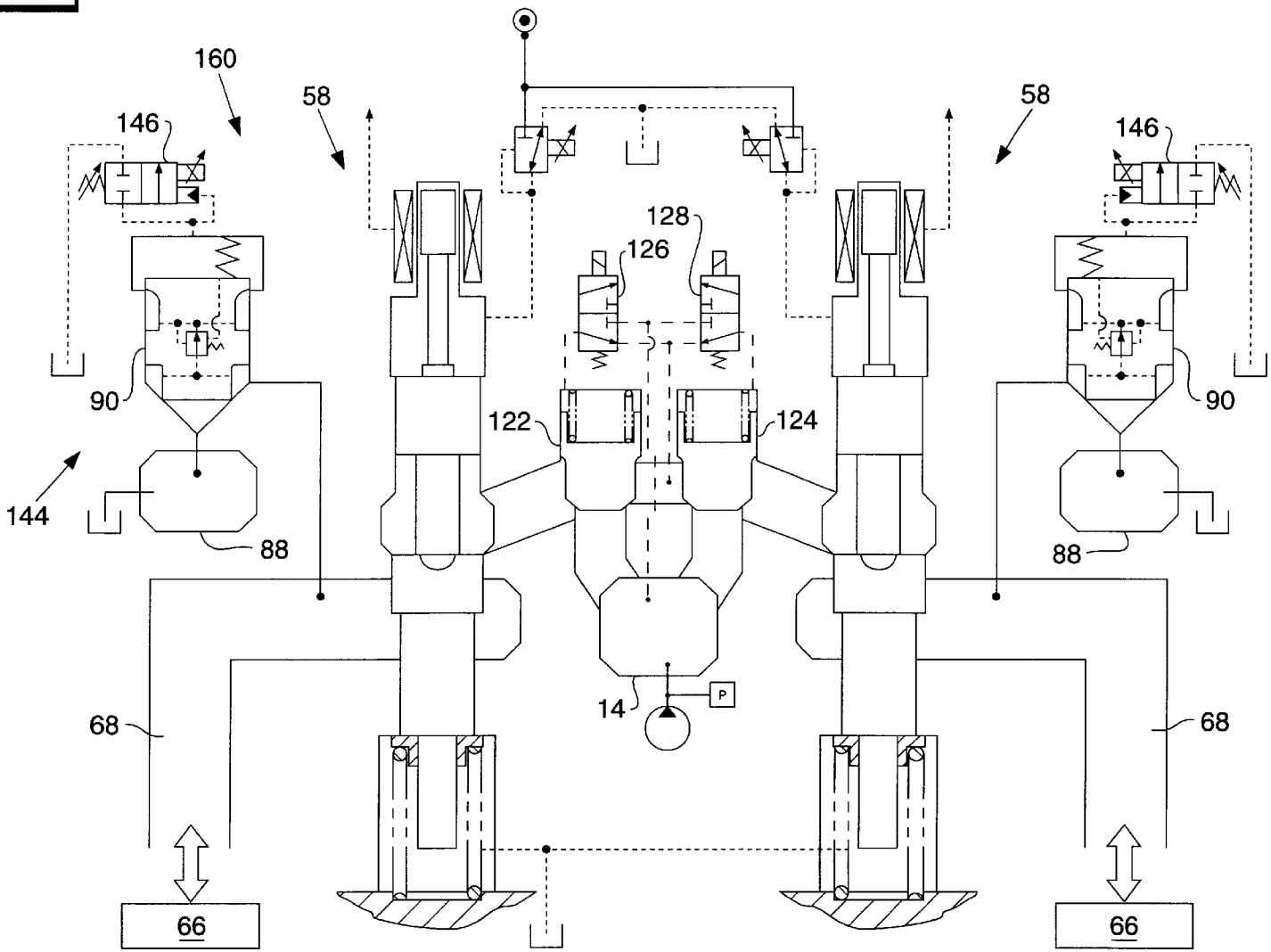
FIG. 4 is a schematic illustration of yet another embodiment of a hydraulic system of the present invention.

Referring now to FIG. 4 yet another embodiment of the hydraulic system 160 of the present invention is shown. Hydraulic system 160 is somewhat of a combination of the embodiments of hydraulic systems 120 and 140 shown in FIGS. 2 and 3. More particularly, hydraulic system 160 includes two load hold check valves 122, 124 and two three-way valves 126, 128 the same as the embodiment of hydraulic system 120 shown in FIG. 2. Moreover, hydraulic system 160 includes a pair of poppet valves assemblies 144 with each poppet valve assembly including a pilot flow amplification type poppet valve 90 and a variable pressure relief/meter-out flow control valve 146, the same as hydraulic system 140 shown in FIG. 3.

Hydraulic system 10, 120, 140 and 160 provide improved make-up and pressure relief functions for effective operation of other high pressure and/or low pressure hydraulic systems coupled with fluid pump 14. Poppet valve assemblies 60 and 144 provide make-up and line relief functions to an associated actuator without the use of an additional spool valve. The pressure area defined by the shoulder 86 on each spool land 76 of each spool valve provides improved control of the position of the spool within the meter-in spool valve. The two position, three-way valve associated with each load check valve allows the pressure within the pressure control chamber 40 on the back side of each responding valve body to be controlled corresponding to the pump output pressure or the pressure in the parallel fluid lines 32, 34 leading to an associated actuator.

INDUSTRIAL APPLICABILITY

During use, pressure source 14 provides hydraulic fluid as an output pressure to outlet line 24 leading to load hold check valve 16. When three-way valve 18 is in the position shown in FIG. 1, the fluid pressure within parallel fluid lines 32, 34 also exists within pressure control chamber 40 of load hold check valve 16 on the back side of valve body 36. If the pressure outputted from pump 14 is greater than the combined axial force exerted against valve body 36 by compression spring 38 and the fluid pressure within pressure control chamber 40, valve body 36 lifts and allows pressurized hydraulic fluid to flow to meter-in spool valve 58. Pressurized fluid is applied to pressure control chamber 72 within meter-in spool valve 58 in opposition to compression spring 78 to proportionally move spool land 76 to a selected position, allowing a predetermined amount of fluid flow between inlet 62 and outlet 64. The pressurized hydraulic fluid then flows through supply line 68 to actuator 66.

Load hold check valve 36 may be closed by moving three-way valve 18 to a position such that first port 46 is fluidly coupled with third port 50, thereby coupling the output pressure of pump 14 to the pressure control chamber on the back side of valve body 36. Additional force provided by compression spring 38 moves valve body 36 to the closed position shown in FIG. 1.

In the event that the output pressure from pump 14 falls below the fluid pressure within supply line 68, such as when pump 14 provides fluid under low pressure conditions to an auxiliary hydraulic load 28, it is also possible to allow back flow of the hydraulic fluid for more effective operation of auxiliary hydraulic load 28. For example, assuming valve body 36 is in a closed position and spool land 76 is in an open position, the pressure within supply line 68 also exists within parallel fluid line 32 and exerts an axial force against valve body 36 at shoulders 42 and 44. If three-way valve 18 is biased to the position coupling the output pressure of pump 14 to pressure control chamber 40, a lower pressure thus exists under a high flow rate, low pressure operating condition during operation of auxiliary hydraulic load 28. The higher pressure hydraulic fluid exerts an axial force against valve body 36 at shoulders 42, 44 moving valve body 36 to an open position allowing the higher pressure hydraulic fluid to be fluidly coupled with the output line 24 from pump 14 which couples in parallel with auxiliary line 30 leading to auxiliary hydraulic load 28.

The exact position of spool land 76 is sensed using stroke sensor 70. The sensed position of spool land 76 is utilized to apply an appropriate pressure to pressure control chamber 72 on the back side of body 74 allowing accurate positioning of spool land 76 within meter-in spool valve 58. The pressure area defined by shoulder 86 of spool land 76 also allows the pressure within supply line 68 to exert an axial force which, in combination with the spring force applied by spring 78, opposes the axial force applied to valve body 74 within pressure control chamber 72 by the pressurized fluid therein. These opposing forces allow improved control and positioning of spool land 76.

In the event that the fluid supply from pump 14 is insufficient to provide adequate fluid flow to actuator 66, cavitation may occur which is undesirable. Pilot flow amplification type poppet valve 90 opens when the pressure in the tank 88 exceeds the pressure within supply line 68, thereby providing a make-up function of hydraulic fluid from tank 88 to supply line 68, and ultimately to actuator 66 to inhibit the cavitation condition.

Moreover, should the pressure within supply line 68 exceed a predetermined value, the same pressure is exerted against pilot relief valve 92. The pop off pressure of pilot relief valve 92 is controlled using proportional pressure reduction valve 96. The meter-out flow control pilot spool valve 94 controls the movement of the valve body 102 and thus permits proportional control of fluid from the actuator 66 to the tank 88 across the valve body 102. Thus, the pop off pressure within supply line 68 as well as the rate of pressure bleed from supply line 68 are controlled using valves 92, 94 and 96.

Other aspects, objects and advantages of this invention can be obtained from a study of the drawings, the disclosure and the appended claims.

What is claimed is:

1. A hydraulic system, comprising:

a hydraulic pressure source;

at least one meter-in spool valve, each said spool valve having an inlet and an outlet;

a hydraulic actuator fluidly coupled with said spool valve outlet;

a load hold check valve fluidly interconnecting said pressure source with at least one said spool valve inlet, said load hold check valve having a pressure control chamber; and a three-way valve having a first port in fluid communication with said pressure control chamber, a second port in fluid communication with at least one said spool valve inlet, and a third port in fluid communication with said pressure source.

2. The hydraulic system of claim 1, including a second load hold check valve and a second three-way valve, said second load hold check valve having a pressure control chamber, said second load hold check valve having a first port in fluid communication with said pressure control chamber of said second load hold check valve, a second port in fluid communication with at least one said spool valve inlet, and a third port in fluid communication with said pressure source.

3. The hydraulic system of claim 1, said three-way valve being a two position valve.

4. The hydraulic system of claim 1, said three-way valve including a solenoid.

5. The hydraulic system of claim 1, said at least one meter-in spool valve being two meter-in spool valves coupled in parallel with said load hold check valve.

6. The hydraulic system of claim 1, said hydraulic pressure source being a pump.

7. A work machine, comprising:

a frame; and a hydraulic system including:

a hydraulic pressure source;

at least one meter-in spool valve, each said spool valve having an inlet and an outlet;

a hydraulic actuator fluidly coupled with said spool valve outlet;

a load hold check valve fluidly interconnecting said pressure source with each said spool valve inlet, said load hold check valve having a pressure chamber; and a three-way valve having a first port in fluid communication with said pressure control chamber, a second fluid port in fluid communication with at least one said spool valve inlet, and a third port in fluid communication with said pressure source.

8. The work machine of claim 7, including a second load hold check valve and a second three-way valve, said second load hold check valve having a pressure control chamber, said second load hold check valve having a first port in fluid communication with said pressure control chamber of said second load hold check valve, a second fluid port in fluid communication with at least one said spool valve inlet, and a third port in fluid communication with said pressure source.

9. The work machine of claim 7, said three-way valve being a two position valve.

10. The work machine of claim 7, said three-way valve including a solenoid.

11. The work machine of claim 7, said at least one meter-in spool valve being two meter-in spool valves coupled in parallel with said load hold check valve.

12. A hydraulic system, comprising:

a hydraulic pump;

at least one meter-in spool valve, each said spool valve having an inlet and an outlet;

at least one hydraulic actuator, each said hydraulic actuator fluidly coupled with a corresponding said spool valve outlet;

a load hold check valve fluidly interconnecting said pump with each said spool valve inlet;

a tank; and at least one poppet valve assembly, each said poppet valve assembly fluidly connected with a corresponding said spool valve outlet and said actuator, each said poppet valve assembly including a pilot flow amplification type poppet valve, a pilot relief valve, a meter-out flow control pilot spool valve and a proportional pressure reduction valve, each said poppet valve assembly selectively interconnecting said corresponding actuator with one of said tank and an ambient pressure.

13. The hydraulic system of claim 12, said pilot relief valve being coupled in parallel with said pilot flow amplification type poppet valve.

14. A hydraulic system, comprising:

a hydraulic pump;

at least one meter-in spool valve, each said spool valve having an inlet and an outlet;

at least one hydraulic actuator, each said hydraulic actuator fluidly coupled with a corresponding said spool valve outlet;

a load hold check valve fluidly interconnecting said pump with each said spool valve inlet;

a tank; and at least one poppet valve assembly, each said poppet valve assembly fluidly connected with a corresponding said spool valve outlet and said actuator, each said poppet valve assembly including a pilot flow amplification type poppet valve, and a variable pressure pilot relief/meter-out flow control pilot spool valve, each said poppet valve assembly selectively interconnecting said corresponding actuator with one of said tank and an ambient pressure.

15. A hydraulic system, comprising:

a hydraulic pump;

at least one meter-in spool valve, each said meter-in spool valve having an inlet and an outlet, each said meter-in spool valve including a spool and a stroke sensor, said stroke sensor configured for providing a signal indicative of a position of said spool;

at least one hydraulic actuator, each said hydraulic actuator fluidly coupled with a corresponding said spool valve outlet;

a load hold check valve fluidly interconnecting said pump with each said spool valve inlet;

a tank; and at least one poppet valve assembly, each said poppet valve assembly fluidly connected with a corresponding said spool valve outlet and said actuator, each said poppet valve assembly selectively interconnecting said corresponding actuator with one of said tank and an ambient pressure.

16. The hydraulic system of claim 15, said spool including a pressure area in communication with at least one said actuator.

17. The hydraulic system of claim 16, said pressure area being a shoulder.

18. A work machine, comprising:

a frame; and a hydraulic system including:

a hydraulic pump;

at least one meter-in spool valve, each said spool valve having an inlet and an outlet;

at least one hydraulic actuator, each said hydraulic actuator fluidly coupled with a corresponding said spool valve outlet;

a load hold check valve fluidly interconnecting said pump with each said spool valve inlet;

a tank; and at least one poppet valve assembly, each said poppet valve assembly fluidly connected with a corresponding said spool valve outlet and said actuator, each said poppet valve assembly including a pilot flow amplification type poppet valve, a pilot relief valve, a meter-out flow control pilot spool valve and a proportional pressure reduction valve, each said poppet valve assembly selectively interconnecting said corresponding actuator with one of said tank and an ambient pressure.

19. The work machine of claim 18, said pilot relief valve being coupled in parallel with said pilot flow amplification type poppet valve.

20. A work machine, comprising:

a frame; and a hydraulic system including:

a hydraulic pump;

at least one meter-in spool valve, each said spool valve having an inlet and an outlet;

at least one hydraulic actuator, each said hydraulic actuator fluidly coupled with a corresponding said spool valve outlet;

a load hold check valve fluidly interconnecting said pump with each said spool valve inlet;

a tank; and at least one poppet valve assembly, each said poppet valve assembly fluidly connected with a corresponding said spool valve outlet and said actuator, each said poppet valve assembly including a pilot flow amplification type poppet valve, and a variable pressure pilot relief/meter-out flow control pilot spool valve, each said poppet valve assembly selectively interconnecting said corresponding actuator with one of said tank and an ambient pressure.

21. A work machine, comprising:

a frame; and a hydraulic system including:

a hydraulic pump;

at least one meter-in spool valve, each said spool valve having an inlet and an outlet, each said meter-in spool valve including a spool and a stroke sensor, said stroke sensor configured for providing a signal indicative of a position of said spool;

at least one hydraulic actuator, each said hydraulic actuator fluidly coupled with a corresponding said spool valve outlet;

a load hold check valve fluidly interconnecting said pump with each said spool valve inlet;

a tank; and at least one poppet valve assembly, each said poppet valve assembly fluidly connected with a corresponding said spool valve outlet and said actuator, each said poppet valve assembly selectively interconnecting said corresponding actuator with one of said tank and an ambient pressure.

22. The work machine of claim 21, said spool including a pressure area in communication with at least one said actuator.

23. The work machine of claim 22, said pressure area being a shoulder.

* * * * *